US007178900B2

(12) United States Patent
Blouin et al.

(10) Patent No.: US 7,178,900 B2
(45) Date of Patent: Feb. 20, 2007

(54) PRINTER FLUID MANAGEMENT SYSTEM

(75) Inventors: Matthew Blouin, Townsend, MA (US); Douglas J. Barrett, Westford, MA (US); Alan H. Jones, Arlington, MA (US)

(73) Assignee: Creo Americas, Inc., Norwalk, CT (US)

( * ) Notice: Subject to any disclaimer, the term of this patent is extended or adjusted under 35 U.S.C. 154(b) by 900 days.

(21) Appl. No.: 10/118,611

(22) Filed: Apr. 8, 2002

(65) Prior Publication Data

US 2003/0189623 A1 Oct. 9, 2003

(51) Int. Cl.
*B41J 2/14* (2006.01)
*B41J 2/165* (2006.01)
*B41J 2/175* (2006.01)

(52) U.S. Cl. ..... 347/49; 347/36; 347/86

(58) Field of Classification Search ..... 347/21, 347/28, 36, 49, 86
See application file for complete search history.

(56) References Cited

U.S. PATENT DOCUMENTS

| | | | |
|---|---|---|---|
| 4,695,824 | A | 9/1987 | Tazaki |
| 5,682,191 | A | 10/1997 | Barrett et al. |
| 6,022,101 | A | 2/2000 | Sabonis |

FOREIGN PATENT DOCUMENTS

| | | | |
|---|---|---|---|
| EP | 0 664 218 | A2 | 7/1995 |
| EP | 0 808 716 | A | 11/1997 |
| EP | 1 033 252 | A | 9/2000 |
| EP | 1 060 895 | A | 12/2000 |
| EP | 1 138 503 | A1 | 10/2001 |

*Primary Examiner*—Shih-Wen Hsieh

(57) ABSTRACT

A printer fluid management module is disclosed that includes a first jet writing fluid vessel having a first end in which a fluid opening is defined, and a first utility fluid vessel having a first end in which a fluid opening is defined. The first jet writing fluid vessel and the first utility fluid vessel are part of a unitary assembly.

57 Claims, 5 Drawing Sheets

PRINTER FLUID MANAGEMENT SYSTEM

FIELD OF THE INVENTION

This invention relates to fluid management systems for printers, including systems that deliver ink and cleaning fluid to a print head and collect the resulting waste.

BACKGROUND OF THE INVENTION

Numerous types of printer cartridges have been designed to supply ink to be used by one or more print channels. These include unitary single-color and multi-color disposable cartridges for a number of different types of consumer-oriented inkjet printers. Some of these cartridges are designed to include integral ink deposition structures that are disposed of with the cartridges. Others rely on absorbent pads and small amounts of ink to clean their deposition structures.

Professional large-format graphic arts printers tend to require larger amounts of ink. These are typically provided in larger bottles that are individually installed in the printer. Large-format printers also generally include non-disposable ink deposition structures and a cleaning fluid delivery system to clean these structures. They are therefore usually equipped with a relatively large cleaning fluid bottle and an often larger waste bottle.

SUMMARY OF THE INVENTION

In one general aspect, the invention features a printer fluid management module that includes a first jet writing fluid vessel having a first end in which a fluid opening is defined, and a first utility fluid vessel having a first end in which a fluid opening is defined. The first jet writing fluid vessel and the first utility fluid vessel are part of a unitary assembly.

In preferred embodiments, the first jet writing fluid vessel can have a second end and four sidewalls, with the first utility fluid vessel having a second end and four sidewalls and the fluid management module including a rigid structure. The first jet writing fluid vessel and utility fluid vessel can include flexible walls. The first jet writing fluid vessel and the utility fluid vessel can be bags. The first utility fluid vessel can be a waste fluid vessel. The unitary assembly can further include a cleaning fluid vessel. The waste fluid vessel can include a handle. The handle can be centered approximately on center of gravity of the unitary assembly. The jet writing fluid vessel and the utility fluid vessel can be sufficiently large to allow the printer to print for at least 10 hours without changing the module. The jet writing fluid vessel and the utility fluid vessel can each have a capacity of at least about 200 ml. The jet writing fluid vessel and the utility fluid vessel can each have a capacity of at least about 500 ml. The printer can be a continuous inkjet printer. The printer can be capable of printing on sheets that have dimensions of at least 14×20 inches. The assembly can include a plurality of electrical contacts. The jet writing fluid vessel can be a first primary color ink vessel having a second end and four sidewalls, with the first utility fluid vessel being a waste vessel having a second end and four sidewalls, with the module further including a second primary color ink vessel having a first end in which a fluid opening is defined, a second end, and four sidewalls, a third primary color ink vessel having a first end in which a fluid opening is defined, a second end, and four sidewalls, and a cleaning fluid vessel having a first end in which a fluid opening is defined, a second end, and four sidewalls. The first primary color ink vessel, the second primary color ink vessel, the third primary color ink vessel, the cleaning fluid vessel, and the waste vessel can be keyed to restrict a number of possible nested alignment orders. The first primary color ink vessel, the second primary color ink vessel, the third primary color ink vessel, the cleaning fluid vessel, and the waste vessel can be keyed with recesses and bosses. The first primary color ink vessel, the second primary color ink vessel, the third primary color ink vessel, the cleaning fluid vessel, and the waste vessel can be keyed with interlocking recesses and bosses. The first primary color ink vessel, the second primary color ink vessel, the third primary color ink vessel, the cleaning fluid vessel, and the waste vessel can be keyed to allow only a single nested alignment order. The waste vessel can be aligned with the first primary color ink vessel, the second primary color ink vessel, the third primary color ink vessel, and the cleaning fluid vessel. The waste vessel can flanked on each side by at least one of the first primary color ink vessel, the second primary color ink vessel, the third primary color ink vessel, the cleaning fluid vessel, and the waste vessel. A volume of the waste vessel can be on the order of the sum of a volume of the first primary color ink vessel, a volume of the second primary color ink vessel, and a volume of the third primary color ink vessel. A volume of the waste vessel can be on the order of the sum of a volume of the first primary color ink vessel, a volume of the second primary color ink vessel, a volume of the third primary color ink vessel, and a volume of the cleaning fluid vessel. The first primary color ink vessel can contains cyan ink, the second primary color ink vessel can contain magenta ink, and the third primary color ink vessel can contain yellow ink. The unitary assembly can include a fourth primary color ink vessel having a first end in which a fluid opening is defined, a second end, and four sidewalls. The first primary color ink vessel can contain cyan ink, the second primary color ink vessel can contain magenta ink, the third primary color ink vessel can contain yellow ink, and the fourth primary color ink vessel can contain black ink. The fluid management module can include a rigid structure.

In another general aspect, the invention features a printer fluid management module that includes a first jet writing fluid vessel having a first end in which a fluid opening is defined, a first utility fluid vessel having a first end in which a fluid opening is defined, wherein the first jet writing fluid vessel and the first utility fluid are shaped to allow them to be placed adjacent each other with voids between them through which an alignment post can pass.

In preferred embodiments, the first jet writing fluid vessel and the first utility fluid vessel can be part of a unitary assembly. The jet writing fluid vessel can be a first primary color ink vessel having a second end and four sidewalls, with the first utility fluid vessel being a waste vessel having a second end and four sidewalls, and with the module further including a second primary color ink vessel having a first end in which a fluid opening is defined, a second end, and four sidewalls, a third primary color ink vessel having a first end in which a fluid opening is defined, a second end, and four sidewalls, a cleaning fluid vessel having a first end in which a fluid opening is defined, a second end, and four sidewalls, and wherein the first primary color ink vessel, the second primary color ink vessel the third primary color ink vessel, the waste vessel, and the cleaning fluid vessel are all shaped to allow them to be placed adjacent each other with voids between them through which alignment posts can pass. The first primary color ink vessel, the second primary color ink vessel, the third primary color ink vessel, the cleaning fluid vessel, and the waste vessel can be part of a unitary assembly. The first primary color ink vessel, the second primary color ink vessel, the third primary color ink vessel, the cleaning fluid vessel, and the waste vessel can be keyed to restrict a number of possible nested alignment orders. The waste vessel can be flanked on each side by at least one of the first primary color ink vessel, the second primary color ink vessel, the third primary color ink vessel, and the cleaning fluid vessel. A volume of the waste vessel can be on the order of the sum of a volume of at least the first primary color ink vessel, a volume of the second primary color ink vessel, and a volume of the third primary color ink vessel. The fluid management module can include a rigid structure.

In a further general aspect, the invention features a printer fluid management module that includes a first jet writing fluid vessel having a first end in which a fluid opening is defined, a waste fluid vessel having a first end in which a fluid opening is defined, a cleaning fluid vessel having a first end in which a fluid opening is defined, wherein the waste vessel is aligned with and placed between the first primary color ink vessel and the cleaning fluid vessel.

In preferred embodiments, the first jet writing fluid vessel and the first utility fluid vessel can be part of a unitary assembly. The jet writing fluid vessel can be a first primary color ink vessel having a second end and four sidewalls, with the waste vessel having a second end and four sidewalls, with the cleaning fluid vessel having a second end and four sidewalls, and with the module further including a second primary color ink vessel having a first end in which a fluid opening is defined, a second end, and four sidewalls, a third primary color ink vessel having a first end in which a fluid opening is defined, a second end, and four sidewalls. The second and third primary color ink vessels can be placed on opposite sides of the waste vessel. The first primary color ink vessel, the second primary color ink vessel, the third primary color ink vessel, the cleaning fluid vessel, and the waste vessel can be part of a unitary assembly. The first primary color ink vessel, the second primary color ink vessel, the third primary color ink vessel, the cleaning fluid vessel, and the waste vessel can be keyed to restrict a number of possible nested alignment orders. A volume of the waste vessel can be on the order of the sum of a volume of at least the first primary color ink vessel, a volume of the second primary color ink vessel, and a volume of the third primary color ink vessel.

In another general aspect, the invention features a printer fluid management method that includes providing a unitary fluid management module that includes an aligned collection, comprising a first jet writing fluid vessel having a first end in which a fluid opening is defined, a waste fluid vessel having a first end in which a fluid opening is defined, and a cleaning fluid vessel having a first end in which a fluid opening is defined. The method also includes the steps of mating the opening in the first jet fluid vessel and the opening in the cleaning fluid vessel with respective ones of a series of aligned fluid inlets, and mating the opening in the waste vessel with a fluid outlet.

In a further general aspect, the invention features a printer fluid management method that includes providing a fluid management module that includes an aligned collection, comprising a first jet writing fluid vessel having a first end in which a fluid opening is defined, a waste fluid vessel having a first end in which a fluid opening is defined, and a cleaning fluid vessel having a first end in which a fluid opening is defined. The method also includes the steps of mating the opening in the first jet fluid vessel and the opening in the cleaning fluid vessel with respective ones of a series of aligned fluid inlets, and mating the opening in the waste vessel with a fluid outlet located opposite the series of aligned vessels with respect to the waste vessel.

In preferred embodiments, the step of mating the opening in the waste vessel can include a step of mating a fitting at an end of a flexible hose to the opening in the waste vessel. The step of mating the opening in the waste vessel can cause a step of releasing a printer-enabling interlock. The step of releasing a printer-enabling interlock can include releasing a mechanical door interlock mechanism. The step of releasing a printer-enabling interlock can include making at least one electrical contact. The step of releasing a printer-enabling interlock can include making at least one electrical contact to a conductive area on the module.

In another general aspect, the invention features a printer fluid management module that includes means for storing jet writing fluid including means for dispensing the jet fluid, means for storing utility fluid including means for passing the utility fluid, and means for holding the means for storing jet writing fluid and the means for storing utility fluid together.

In a further general aspect, the invention features a printer fluid management module that includes means for storing jet writing fluid including means for dispensing the jet fluid, means for storing utility fluid including means for passing the utility fluid, and means for allowing an alignment means to protrude between the means for storing jet writing fluid and the means for storing utility fluid.

In another general aspect, the invention features a printer fluid management module that includes means for storing jet writing fluid including means for dispensing the jet fluid, means for storing cleaning fluid including means for dispensing the cleaning fluid, and means for storing waste fluid including means for accepting the waste fluid, located between the means for storing jet writing fluid and the means for storing cleaning fluid.

In a further general aspect, the invention features a printer fluid management module that includes a first jet writing fluid vessel having a first end in which a fluid opening is defined, a waste fluid vessel having a first end in which a fluid opening is defined, a cleaning fluid vessel having a first end in which a fluid opening is defined, and wherein the waste vessel includes a bottom surface that lies above a predetermined plane, and wherein the opening in the first end of the first jet writing fluid vessel and the opening in the first end of the cleaning fluid vessel are located below the predetermined plane.

In preferred embodiments, the bottom surface of the waste vessel can be constructed and adapted to sit on a shelf and thereby support at least some of the weight of the module. The first jet writing fluid vessel, the cleaning fluid vessel, and the first utility fluid vessel can be part of a unitary assembly. The jet writing fluid vessel can be a first primary color ink vessel having a second end and four sidewalls, with the waste vessel having a second end and four sidewalls, and the cleaning fluid vessel having a second end and four sidewalls, and with the module further including a second primary color ink vessel having a first end in which a fluid opening is defined, a second end, and four sidewalls, a third primary color ink vessel having a first end in which a fluid opening is defined, a second end, and four sidewalls, a cleaning fluid vessel having a first end in which a fluid opening is defined, a second end, and four sidewalls, and with the first primary color ink vessel, the second primary color ink vessel the third primary color ink vessel, the waste vessel, and the cleaning fluid vessel all being shaped to allow them to be placed adjacent each other with voids between them through which alignment posts can pass. The waste vessel can be flanked on each side by at least one of the first primary color ink vessel, the second primary color ink vessel, the third primary color ink vessel, and the cleaning fluid vessel. A volume of the waste vessel can be on the order of the sum of a volume of at least the first primary color ink vessel, a volume of the second primary color ink vessel, and a volume of the third primary color ink vessel.

In another general aspect, the invention features a printer fluid management method that includes mating a fluid opening in a first jet writing fluid vessel and an opening in a first cleaning fluid vessel with respective inlets located below a predetermined plane, and maintaining a bottom surface of a waste fluid vessel above the predetermined plane during the step of mating. In preferred embodiments, the step of maintaining can be performed by a step of supporting by a surface coincident with the predetermined plane.

In a further general aspect, the invention features a printer fluid management method that includes means for mating a fluid opening in a first jet writing fluid vessel and an opening in a first cleaning fluid vessel with respective inlets located below a predetermined plane, and means for maintaining a waste fluid vessel above the predetermined plane.

In another general aspect, the invention features a printer fluid management bay assembly that includes a jet writing fluid inlet, a movable waste fluid outlet, and an interlock responsive to the movable waste fluid outlet to prevent printing unless the movable waste fluid outlet is positioned at a predetermined position.

In preferred embodiments, the interlock can include a mechanism operative to prevent closure of a cover of the bay. The interlock mechanism can include a latching mechanism for latching the cover of the bay.

In a further general aspect, the invention features a printer fluid management method that includes mating an opening in a first jet fluid vessel with a fluid inlet, mating an opening in a waste vessel with a movable fluid outlet, and releasing an interlock in response to the step of mating an opening in a waste vessel.

In preferred embodiments, the step of releasing an interlock can include releasing a mechanical door interlock mechanism. The step of releasing an interlock can include making at least one electrical contact.

In another general aspect, the invention features a printer fluid management bay assembly that includes means for providing jet writing fluid, means for receiving waste fluid, movable means for providing the waste fluid to the means for removing waste fluid, and interlock means responsive to the movable means for providing the waste fluid.

Printer fluid management systems according to the invention can be advantageous in that they allow for rapid loading and unloading of ink, cleaning fluid, and waste fluid. This is because it is significantly faster to load single assemblies into a printer than it is to load separate ink bottles, cleaning fluid bottles, and waste bottles, particularly if these bottles are individually packaged. And a single assembly can prevent loading errors, which can spoil a whole print run, resulting in the loss of valuable time, ink, and paper.

These advantages can be provided for in larger printers by providing for a series of sturdy alignment posts that cooperate with a series of alignment channels that are located generally between fluid compartments. The alignment posts can reliably guide and support the large fluid compartments that hold the large amounts of ink necessary for large format printers. The alignment posts are also compatible with a multi-part assembly process that is well suited to producing larger fluid-tight cartridges.

Printer fluid management systems according to the invention may also provide for a balanced fluid management cartridge. This type of cartridge can include a handle centered about its center of gravity, making it easier to handle and insert. It can also include a central waste bottle, which keeps its center of gravity from moving excessively as it is emptied. This balanced design is particularly important in large-format or high-volume systems because of the relatively heavy weight of the large amounts of ink and cleaning fluid used by such printers.

DETAILED DESCRIPTION OF AN ILLUSTRATIVE EMBODIMENT

Figure 1:
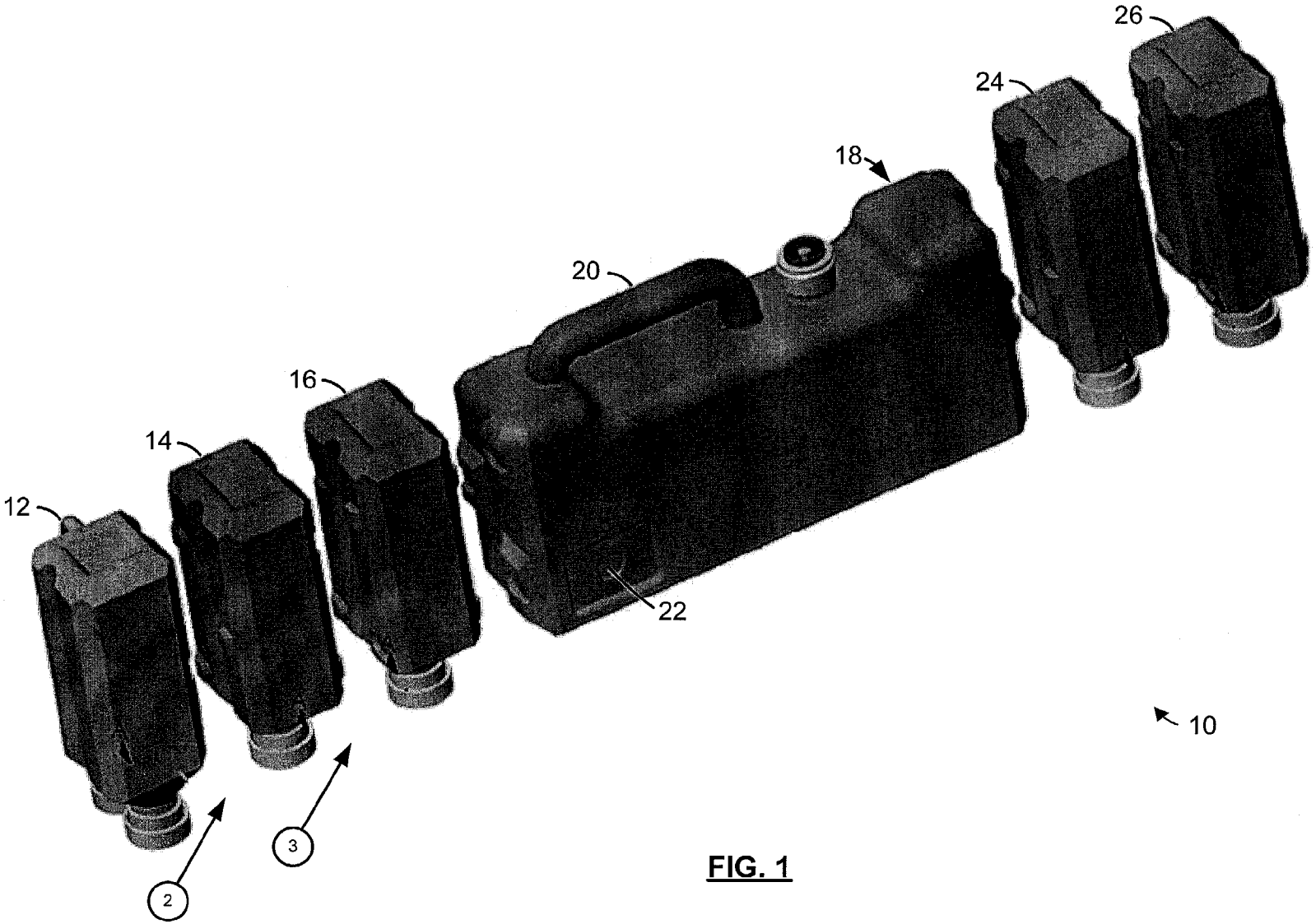
FIG. 1 is an exploded perspective view of a fluid management cartridge according to the invention.

Referring to FIG. 1, a fluid management cartridge 10 for use with a large-format continuous inkjet printer includes a cleaning fluid bottle 12, a first ink bottle 14, a second ink bottle 16, a waste bottle 18, a third ink bottle 24, and a fourth ink bottle 26. The ink bottles can hold different inkjet printing inks that are suitable for the printer that uses the cartridge. In this embodiment these include, respectively, cyan, magenta, yellow, and black dye-based inks, but other ink systems that other numbers of ink bottles could also be used (e.g., ,5 6, 7, or 8 bottles). The cleaning fluid bottle can hold any cleaning fluid that is suitable for cleaning the inks from the parts of the printer that need to be cleaned. In this embodiment, the cleaning fluid can include water, a surfactant, and a biostat or a biocide. The design of the cartridge is essentially independent of the exact composition of the fluids it can carry, and these therefore do not need to be described in more detail here.

The waste bottle can include a handle 20. This handle is preferably a U-shaped or partially U-shaped handle that includes a grasping area that is preferably long enough that a user can wrap all of his or her fingers around it. In one embodiment, the length of the grasping area of this handle substantially exceeds the cumulative width of the fingers of a 95-percentile male user.

The handle is preferably centered about the center of gravity of the cartridge. This makes the cartridge easy and safe to carry and insert. It is also preferable to keep the waste fluid bottle in or near the center of the assembly, so that the cartridge remains as balanced as it can be when the inks and cleaning fluid have been used up and the waste bottle is full. If the design is such that the balance point can change, it may be appropriate to make the handle somewhat larger to allow the user to adjust his or her grip. The waste bottle can also include an indented area 22 to carry an electronic element that can be used to identify the contents of the cartridge and track its usage. This element is described in more detail in a copending application filed on the same day as this application and entitled CERTIFIED PROOFING, which is herein incorporated by reference.

Figure 3:
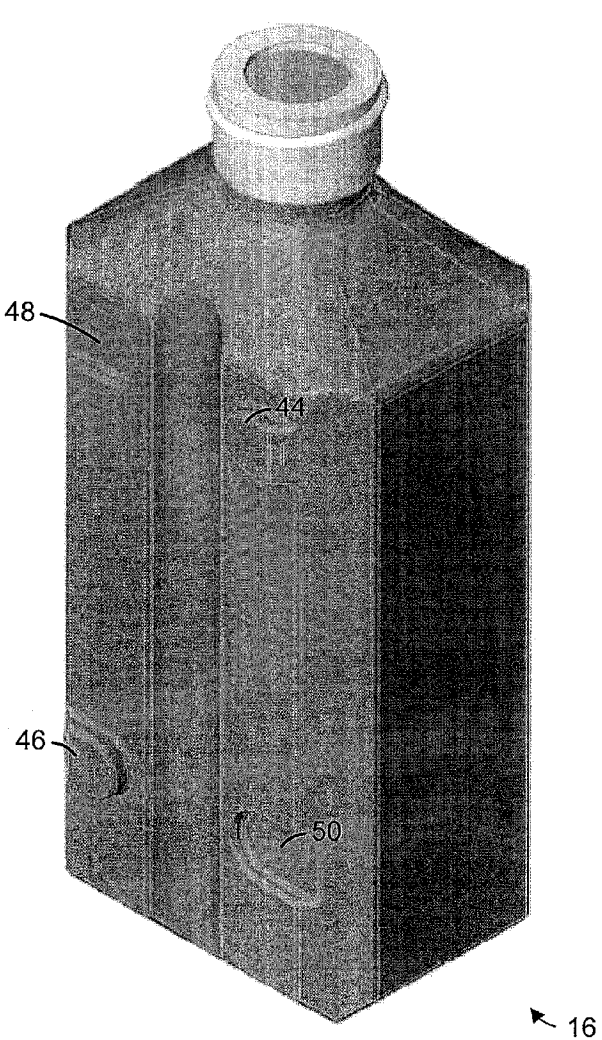
FIG. 3 is a perspective view of the ink bottle of FIG. 2 taken in a direction labeled "3" in FIG. 1.
Figure 2:
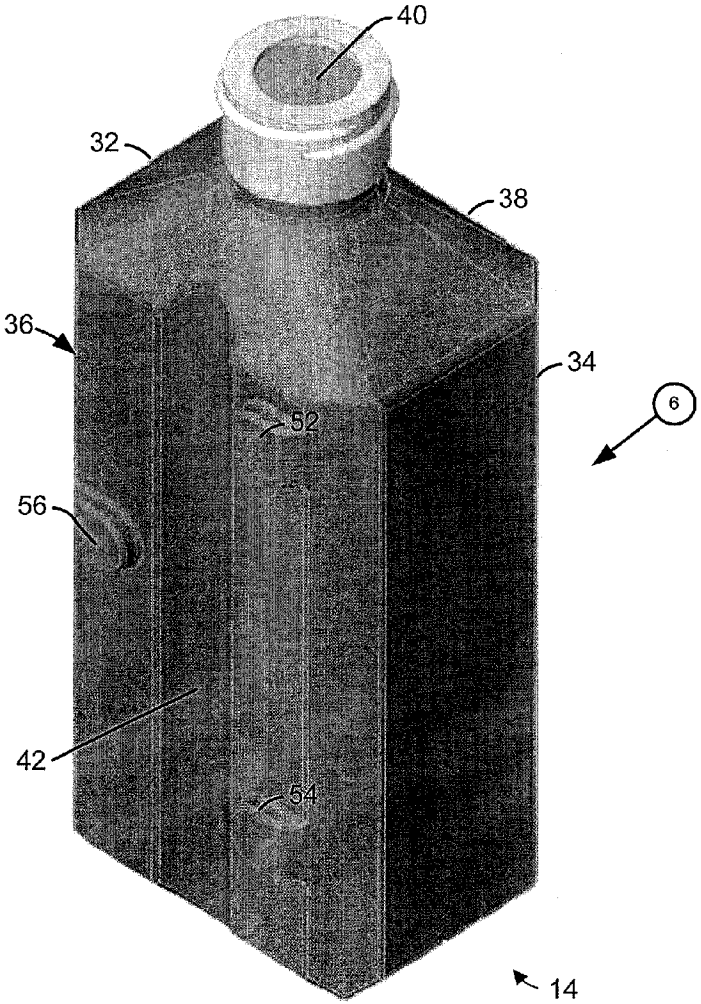
FIG. 2 is a perspective view of an ink bottle for use with the cartridge of FIG. 1 taken in a direction labeled "2" in FIG. 1.

Referring to FIGS. 2 and 3, each of the bottles can be viewed as including an inward face 32, an outward face 34, a forward face 36, and a rear face 38 in the orientation shown in the figures. Each of the bottles can also include an opening. These openings can be located on the bottom of the ink and cleaning fluid bottles, and on the top of the waste bottle in the orientation shown. The cleaning bottle can include two openings to allow cleaning fluid to be recirculated. Each opening can be equipped with one of a number of different types of valves 40. In the present embodiment, the valves on the ink and cleaning fluid bottles are septum-based valves and the valve on the waste bottle is a plunger-based valve.

Figure 4:
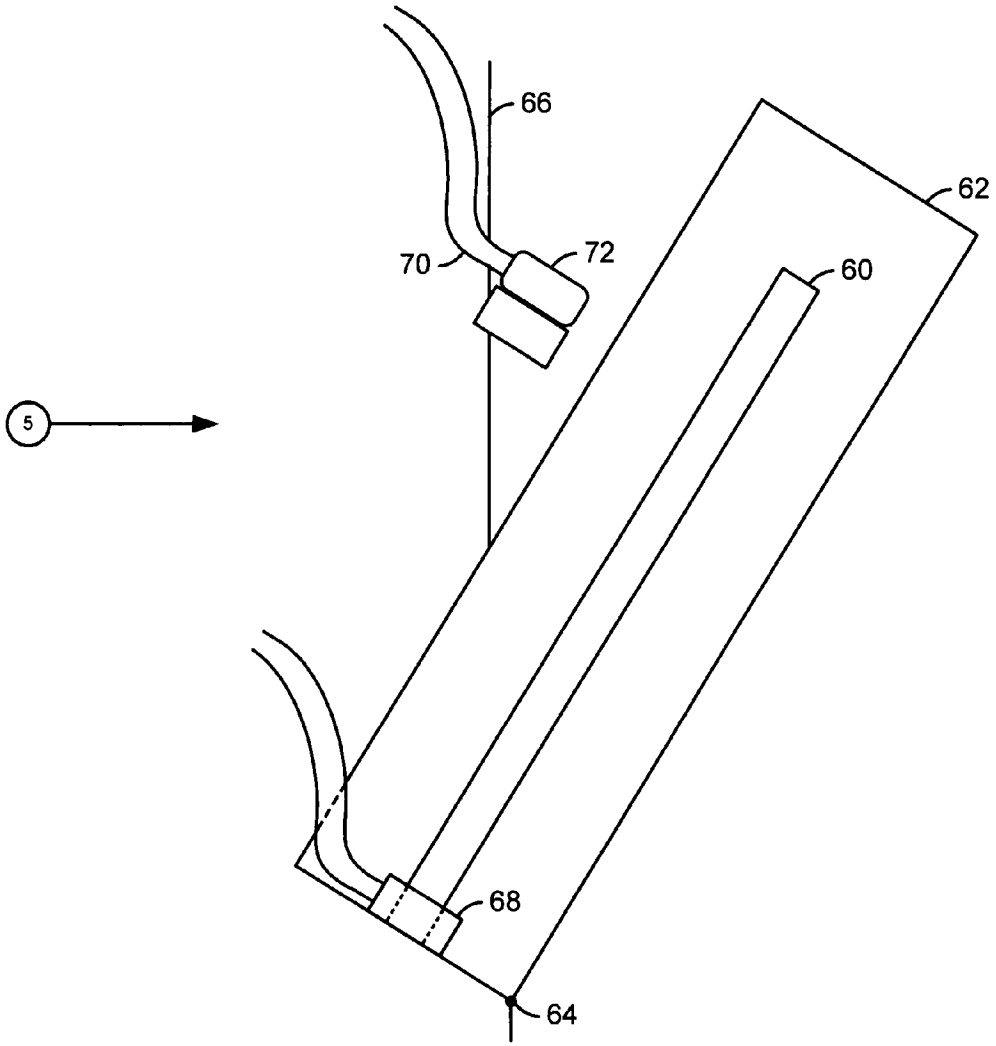
FIG. 4 is a diagrammatic cutaway side view of a hinged cartridge loading compartment for receiving the fluid management cartridge of FIG. 1.

Referring also to FIG. 4, the bottles can also include an indent 42 that allows an alignment post 60 to pass between the bottles. This indent preferably provides a semi-cylindrical support surface that can interact with the post, at least in part. Posts can include a slight bevel at their tops, and they can be provided between some or all of the bottles.

In one embodiment, the cartridge is inserted into a vertical compartment 62 that is mounted with a hinge 64 between its lower front edge and an opening in a wall 66 of the printer. Fluid inlets 68 are provided at the bottom of the compartment to mate with the openings in the bottles and convey fluid from the bottles into the printer. An outlet hose 70 and vented hose cap 72 hang from inside the printer near the top of the compartment to allow for connection to the opening of the waste bottle. Other types of supporting structures and alignment elements can also be provided to support and guide the cartridge during insertion.

Figure 5:
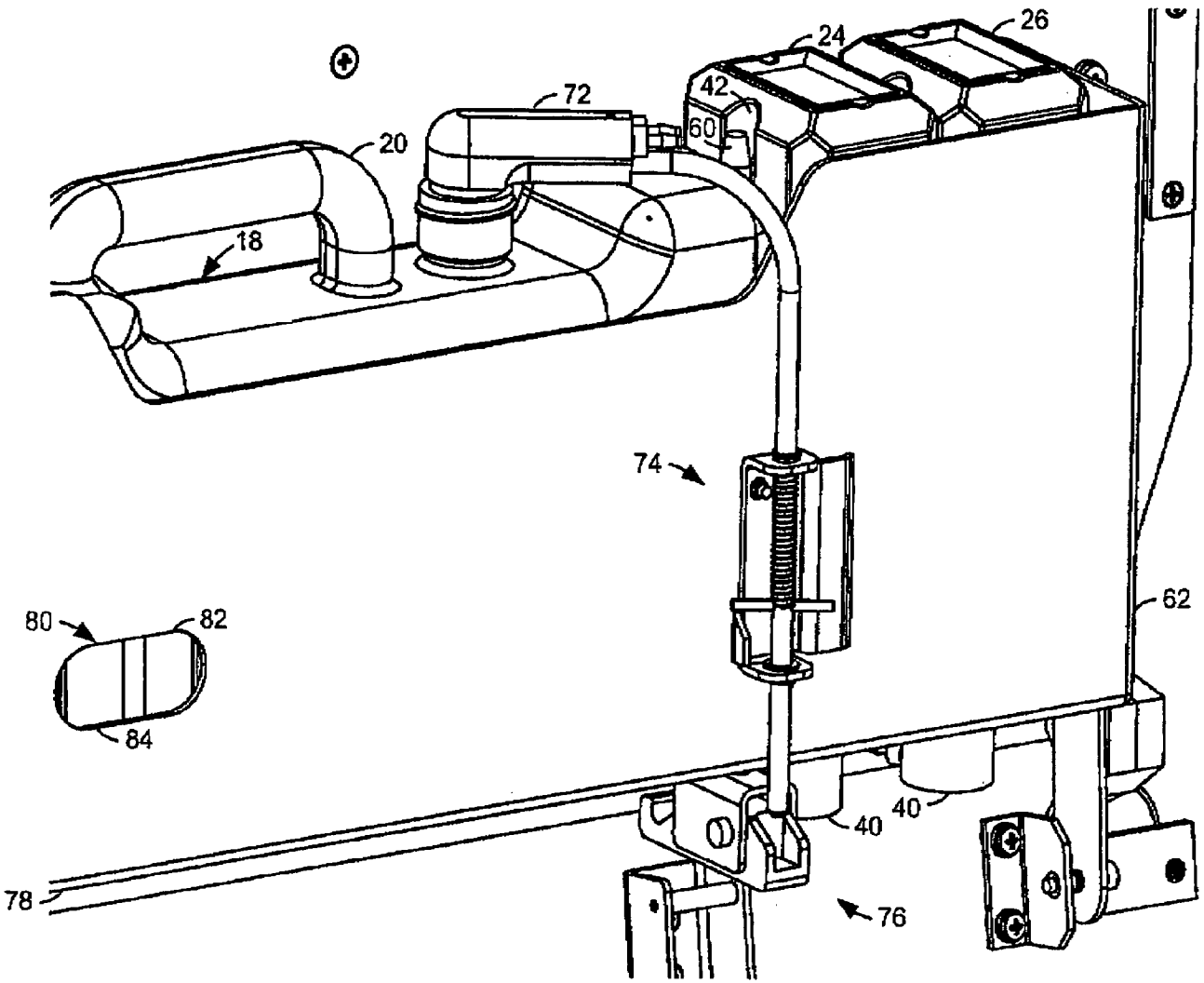
FIG. 5 is a partial perspective view of the loading compartment of FIG. 4 shown holding the cartridge of FIG. 1 and taken in a direction labeled "5" in FIG. 4.

Referring also to FIG. 5, the outlet hose 70 is preferably equipped with an interlock mechanism. This mechanism can include a spring-loaded, sliding hinge mechanism 74, which allows the hose cap 72 to be rotated from inside the printer to a position over the waste valve and then dropped onto the waste valve. This mechanism can also interact with a pivoting latch mechanism 76 that can prevent the hinged compartment from being closed with the waste bottle disconnected.

The inside surface of an outer wall of the hinged vertical compartment 62 can also be provided with a window that exposes the electronic element 80. This can expose two contacts 82 and 84, allowing two contacts to make an electrical connection with them when the door is closed. These contacts can be spring-loaded pins. This arrangement can act as an electronic interlock, which prevents the printer from operating unless the printer can detect the element, and thereby meter ink usage.

Figure 7:
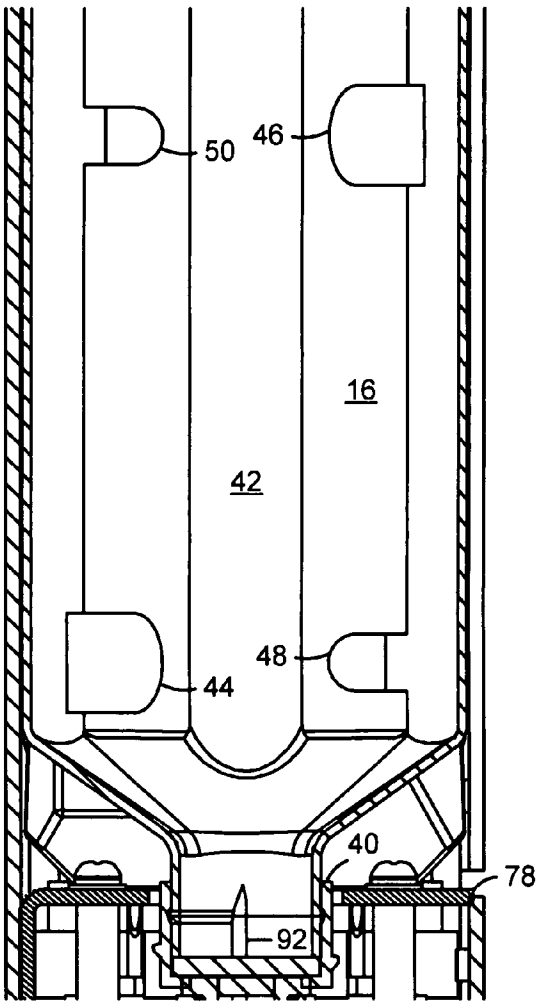
FIG. 7 is the cutaway view of FIG. 6 shown with the cartridge inserted without its protective caps installed.
Figure 6:
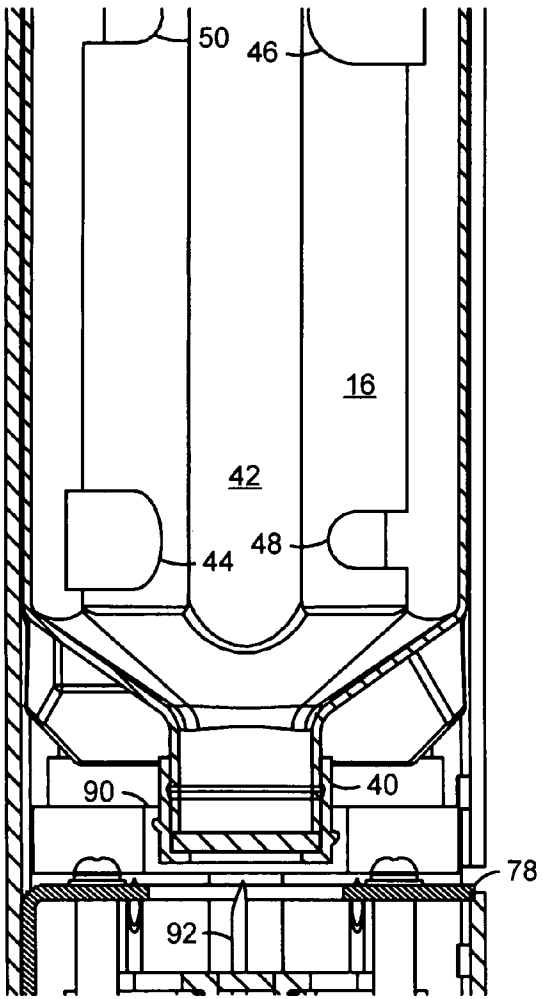
FIG. 6. is a cutaway view of the compartment and cartridge of FIG. 5 shown during an attempt to insert a cartridge with its protective caps installed and taken in a direction labeled "6" in FIG. 2.

Referring also to FIGS. 6 and 7, an intermediate shelf 78 can be provided inside of the compartment and toward its bottom. This shelf can support the weight of the cartridge so that the inlets do not need support its weight. It can also include holes that prevent insertion of the cartridge with its protective caps 90, which might otherwise be pierced by the needles 92 that are intended to pierce the septum.

Although the cartridges can all be mated together using a single type of assembly feature, a multi-type version is preferable, such as the one shown in FIGS. 2 and 3. In this type of arrangement, the cartridges can include more than one type of assembly features. Having different types of assembly features helps to prevent assembly errors.

The first type of assembly feature includes a set of two bosses 44, 46 and two recesses 48, 50 placed in a checkerboard pattern in four corners of a face of the bottle. This feature can connect mate with another instance of itself. The second type of assembly feature exists in male and female versions that cannot mate with other instances of themselves. Male versions of this feature include two bosses 52, 54 on one side of the indent and another 56 on the other side of the indent between the first two, but somewhat closer to the lower one. Female versions are similar to the male ones, but they exhibit recesses instead of bosses.

The cleaning fluid bottle and the waste bottle both include recesses of the second type. The ink bottles include bosses of the second type to mate with the recesses in the cleaning fluid bottle and the waste bottle. They mate with each other using the first type of assembly feature. In this embodiment, the bottles mate in a non-interlocking manner, so once they are mated together, they are shrink-wrapped or otherwise bound together. Of course, other shapes or other types of assembly features, such as interlocking bosses and recesses could also be provided, although it is preferable for these to restrict the number of ways that the cartridge can be assembled, to avoid assembly errors.

Although the bottles are shown as rigid bottles that define a rigid structure for the cartridge in the embodiment shown, it is also possible to use flexible ones. These may allow for a smaller cartridge, because the waste vessel can expand as it fills into space left by the ink vessels as they are emptied. Metal-coated bags are well suited for this type of application because they are relatively expensive and resist ink leakage.

Many features of the fluid management systems according to the invention are also suitable for use in other types of printing systems. These can include other types of ink-based printing systems, such as drop-on-demand inkjet printers. They can also include other types of printing systems, such as direct-to-plate systems, which can dispense a plate-writing fluid. These fluids include direct plate-writing fluids, which by themselves change properties of plates to allow them to be used in printing presses, and indirect plate-writing fluids, which require further process steps. Direct-to-plate systems do not require multiple ink cartridges, but instead require only one plate-writing fluid.

The present invention has now been described in connection with a number of specific embodiments thereof. However, numerous modifications which are contemplated as falling within the scope of the present invention should now be apparent to those skilled in the art. It is therefore intended that the scope of the present invention be limited only by the scope of the claims appended hereto. In addition, the order of presentation of the claims should not be construed to limit the scope of any particular term in the claims.

What is claimed is:

1. A printer fluid management module, comprising:

a first primary color ink vessel having a first end in which a fluid opening is defined, a second end, and four sidewalls a first waste vessel having a first end in which a fluid opening is defined, a second end, and four sidewalls, a second primary color ink vessel having a first end in which a fluid opening is defined, a second end, and four sidewalls, a third primary color ink vessel having a first end in which a fluid opening is defined, a second end, and four sidewalls, a cleaning fluid vessel having a first end in which a fluid opening is defined, a second end, and four sidewalls, wherein the first jet writing fluid vessel and the waste vessel are art of a unitary assembly, and wherein the first primary color ink vessel, the second primary color ink vessel, the third primary color ink vessel, the cleaning fluid vessel, and the waste vessel are keyed to restrict a number of possible nested alignment orders.

2. The apparatus of claim 1 wherein the first primary color ink vessel, the second primary color ink vessel, the third primary color ink vessel, the cleaning fluid vessel, and the waste vessel are keyed with recesses and bosses.

3. The apparatus of claim 1 wherein the first primary color ink vessel, the second primary color ink vessel, the third primary color ink vessel, the cleaning fluid vessel, and the waste vessel are keyed with interlocking recesses and bosses.

4. The apparatus of claim 1 wherein the first primary color ink vessel, the second primary color ink vessel, the third primary color ink vessel, the cleaning fluid vessel, and the waste vessel are keyed to allow only a single nested alignment order.

5. A printer fluid management module, comprising:

a first jet writing fluid vessel having a first end in which a fluid opening is defined, a first utility fluid vessel having a first end in which a fluid opening is defined, and wherein the first jet writing fluid vessel and the first utility fluid are shaped to allow them to be placed adjacent each other with voids between them through which an alignment post can pass.

6. The apparatus of claim 5 wherein the first jet writing fluid vessel and the first utility fluid vessel are part of a unitary assembly.

7. The apparatus of claim 5 wherein the fluid management module includes a rigid structure.

8. The apparatus of claim 7 wherein the first jet writing fluid vessel and utility fluid vessel are bags.

9. The apparatus of claim 5 wherein the first jet writing fluid vessel and utility fluid vessel include flexible walls.

10. The apparatus of claim 5 wherein the first utility fluid vessel is a waste fluid vessel.

11. The apparatus of claim 10 wherein the unitary assembly further includes a cleaning fluid vessel.

12. The apparatus of claim 5 wherein the jet writing fluid vessel and the utility fluid vessel are sufficiently large to allow the printer to print for at least 10 hours without changing the module.

13. The apparatus of claim 5 wherein the jet writing fluid vessel and the utility fluid vessel each have a capacity of at least about 200 ml.

14. The apparatus of claim 5 wherein the jet writing fluid vessel and the utility fluid vessel each have a capacity of at least about 500 ml.

15. The apparatus of claim 5 wherein the printer is a continuous inkjet printer.

16. The apparatus of claim 5 wherein the printer is capable of printing on sheets that have dimensions of at least 14×20 inches.

17. The apparatus of claim 5 wherein the module includes a plurality of electrical contacts.

18. The apparatus of claim 5 wherein the jet writing fluid vessel is a first primary color ink vessel having a second end and four sidewalls, wherein the first utility fluid vessel is a waste vessel having a second end and four sidewalls, and further including:

a second primary color ink vessel having a first end in which a fluid opening is defined, a second end, and four sidewalls, a third primary color ink vessel having a first end in which a fluid opening is defined, a second end, and four sidewalls, a cleaning fluid vessel having a first end in which a fluid opening is defined, a second end, and four sidewalls, and wherein the first primary color ink vessel, the second primary color ink vessel the third primary color ink vessel, the waste vessel, and the cleaning fluid vessel are all shaped to allow them to be placed adjacent each other with voids between them through which alignment posts can pass.

19. The apparatus of claim 18 wherein the first primary color ink vessel, the second primary color ink vessel, the third primary color ink vessel, the cleaning fluid vessel, and the waste vessel are part of a unitary assembly.

20. The apparatus of claim 18 wherein the first primary color ink vessel, the second primary color ink vessel, the third primary color ink vessel, the cleaning fluid vessel, and the waste vessel are keyed to restrict a number of possible nested alignment orders.

21. The apparatus of claim 18 wherein the waste vessel is flanked on each side by at least one of the first primary color ink vessel, the second primary color ink vessel, the third primary color ink vessel, and the cleaning fluid vessel.

22. The apparatus of claim 18 wherein a volume of the waste vessel is on the order of the sum of a volume of at least the first primary color ink vessel, a volume of the second primary color ink vessel, and a volume of the third primary color ink vessel.

23. The apparatus of claim 18 wherein the fluid management module includes a rigid structure.

24. A printer fluid management module, comprising:

a first primary color ink vessel having a first end in which a fluid opening is defined, a second end, and four sidewalls a waste vessel having a first end in which a fluid opening is defined, a second end, and four sidewalls, a cleaning fluid vessel having a first end in which a fluid opening is defined, a second end, and four sidewalls, a second primary color ink vessel having a first end in which a fluid opening is defined, a second end, and four sidewalls, a third primary color ink vessel having a first end in which a fluid opening is defined, a second end, and four sidewalls, wherein the waste vessel is aligned with and placed between the first primary color ink vessel and the cleaning fluid vessel, and wherein the first primary color ink vessel, the second primary color ink vessel, the third primary color ink vessel, the cleaning fluid vessel, and the waste vessel are keyed to restrict a number of possible nested alignment orders.

25. A printer fluid management method, comprising:

providing a fluid management module that includes an aligned collection, comprising:

a first jet writing fluid vessel having a first end in which a fluid opening is defined, a waste fluid vessel having a first end in which a fluid opening is defined, and a cleaning fluid vessel having a first end in which a fluid opening is defined, mating the opening in the first jet fluid vessel and the opening in the cleaning fluid vessel with respective ones of a series of aligned fluid inlets, and mating the opening in the waste vessel with a fluid outlet located opposite the series of aligned vessels with respect to the waste vessel, and mating the opening in the waste vessel causes a step of releasing a printer-enabling interlock.

26. The method of claim 25 wherein the step of releasing a printer-enabling interlock includes releasing a mechanical door interlock mechanism.

27. The method of claim 25 wherein the step of releasing a printer-enabling interlock includes making at least one electrical contact.

28. The method of claim 25 wherein the step of releasing a printer-enabling interlock includes making at least one electrical contact to a conductive area on the module.

29. A printer fluid management module, comprising:

means for storing jet writing fluid including means for dispensing the jet fluid, means for storing utility fluid including means for passing the utility fluid, and means for allowing an alignment means to protrude between the means for storing jet writing fluid and the means for storing utility fluid.

30. A printer fluid management module, comprising:

a first jet writing fluid vessel having a first end in which a fluid opening is defined, a waste fluid vessel having a first end in which a fluid opening is defined, a cleaning fluid vessel having a first end in which a fluid opening is defined, and wherein the waste vessel includes a bottom surface that lies above a predetermined plane, and wherein the opening in the first end of the first jet writing fluid vessel and the opening in the first end of the cleaning fluid vessel are located below the predetermined plane.

31. The apparatus of claim 30 wherein the bottom surface of the waste vessel is constructed and adapted to sit on a shelf and thereby support at least some of the weight of the module.

32. The apparatus of claim 30 wherein the first jet writing fluid vessel, the cleaning fluid vessel, and the first utility fluid vessel are part of a unitary assembly.

33. The apparatus of claim 30 wherein the fluid management module includes a rigid structure.

34. The apparatus of claim 30 wherein the first jet writing fluid vessel, the waste fluid vessel, and the cleaning fluid vessel include flexible walls.

35. The apparatus of claim 34 wherein the first jet writing fluid, the waste fluid vessel, and the cleaning fluid vessel are bags.

36. The apparatus of claim 30 wherein the jet writing fluid vessel, the waste fluid vessel, and the cleaning fluid vessel are sufficiently large to allow the printer to print for at least 10 hours without changing the module.

37. The apparatus of claim 30 wherein the jet writing fluid vessel, the waste fluid vessel, and the cleaning fluid vessel each have a capacity of at least about 200 ml.

38. The apparatus of claim 30 wherein the jet writing fluid vessel, the waste fluid vessel, and the cleaning fluid vessel each have a capacity of at least about 500 ml.

39. The apparatus of claim 30 wherein the printer is a continuous inkjet printer.

40. The apparatus of claim 30 wherein the printer is capable of printing on sheets that have dimensions of at least 14×20 inches.

41. The apparatus of claim 30 wherein the module includes a plurality of electrical contacts.

42. The apparatus of claim 30 wherein the jet writing fluid vessel is a first primary color ink vessel having a second end and four sidewalls, wherein the waste vessel has a second end and four sidewalls, and wherein the cleaning fluid vessel has a second end and four sidewalls, and further including:

a second primary color ink vessel having a first end in which a fluid opening is defined, a second end, and four sidewalls, a third primary color ink vessel having a first end in which a fluid opening is defined, a second end, and four sidewalls, a cleaning fluid vessel having a first end in which a fluid opening is defined, a second end, and four sidewalls, and wherein the first primary color ink vessel, the second primary color ink vessel the third primary color ink vessel, the waste vessel, and the cleaning fluid vessel are all shaped to allow them to be placed adjacent each other with voids between them through which alignment posts can pass.

43. The apparatus of claim 42 wherein the first primary color ink vessel, the second primary color ink vessel, the third primary color ink vessel, the cleaning fluid vessel, and the waste vessel are part of a unitary assembly.

44. The apparatus of claim 42 wherein the first primary color ink vessel, the second primary color ink vessel, the third primary color ink vessel, the cleaning fluid vessel, and the waste vessel are keyed to restrict a number of possible nested alignment orders.

45. The apparatus of claim 42 wherein the waste vessel is flanked on each side by at least one of the first primary color ink vessel, the second primary color ink vessel, the third primary color ink vessel, and the cleaning fluid vessel.

46. The apparatus of claim 42 wherein a volume of the waste vessel is on the order of the sum of a volume of at least the first primary color ink vessel, a volume of the second primary color ink vessel, and a volume of the third primary color ink vessel.

47. The apparatus of claim 42 wherein the fluid management module includes a rigid structure.

48. A printer fluid management method, comprising:

mating a fluid opening in a first jet writing fluid vessel and an opening in a first cleaning fluid vessel with respective inlets located below a predetermined plane, and maintaining a bottom surface of a waste fluid vessel above the predetermined plane during the step of mating.

49. The method of claim 48 wherein the step of maintaining is performed by a step of supporting by a surface coincident with the predetermined plane.

50. A printer fluid management method, comprising:

means for mating a fluid opening in a first jet writing fluid vessel and an opening in a first cleaning fluid vessel with respective inlets located below a predetermined plane, and means for maintaining a waste fluid vessel above the predetermined plane.

51. A printer fluid management bay assembly, comprising:

a jet writing fluid inlet, a movable waste fluid outlet, and an interlock responsive to the movable waste fluid outlet to prevent printing unless the movable waste fluid outlet is positioned at a predetermined position.

52. The apparatus of claim 51 wherein the interlock includes a mechanism operative to prevent closure of a cover of the bay.

53. The apparatus of claim 52 wherein the interlock mechanism includes a latching mechanism for latching the cover of the bay.

54. A printer fluid management method, comprising:

mating an opening in a first jet fluid vessel with a fluid inlet, mating an opening in a waste vessel with a movable fluid outlet, and releasing an interlock in response to the step of mating an opening in a waste vessel.

55. The method of claim 54 wherein the step of releasing an interlock includes releasing a mechanical door interlock mechanism.

56. The method of claim 54 wherein the step of releasing an interlock includes making at least one electrical contact.

57. A printer fluid management bay assembly, comprising:

means for providing jet writing fluid, means for receiving waste fluid, movable means for providing the waste fluid to the means for receiving waste fluid, and interlock means responsive to the movable means for providing the waste fluid.

* * * * *